United States Patent [19]

Busta et al.

[11] Patent Number: 4,855,636

[45] Date of Patent: Aug. 8, 1989

[54] MICROMACHINED COLD CATHODE VACUUM TUBE DEVICE AND METHOD OF MAKING

[76] Inventors: Heinz H. Busta, 223 N. Home Ave., Park Ridge, Ill. 60068; Raul D. Cuellar, 1262 Briarwood, Libertyville, Ill. 60048

[21] Appl. No.: 105,895

[22] Filed: Oct. 8, 1987

[51] Int. Cl.[4] ..... H01J 21/10; H01J 21/36

[52] U.S. Cl. ..... 313/306; 313/250; 313/291; 313/336

[58] Field of Search ..... 313/291, 306, 355, 309, 313/336, 250

[56] References Cited

U.S. PATENT DOCUMENTS 3,066,236 11/1962 Sandbank ..... 313/291 X
3,978,364 8/1976 Dimeff et al. ..... 313/306
4,712,039 12/1987 Hong ..... 313/306 X

*Primary Examiner*—Kenneth Wieder

[57] ABSTRACT

A miniaturized field emitter vacuum tube device and method of making are described. The device includes a needle-shaped field emitter cathode, metal gate and electron collecting anode, which are enclosed by an insulating chamber which is evacuated. The gate electrode may be used to form the insulator-to-metal vacuum seal. Device isolation is achieved by using a highly resistive polycrystalline silicon film. A method of making a field emitter cathode tip is described in which two masking and etching steps form a pair of intersecting lines, the intersection point forming the cathode tip.

18 Claims, 8 Drawing Sheets

FIG. 3E
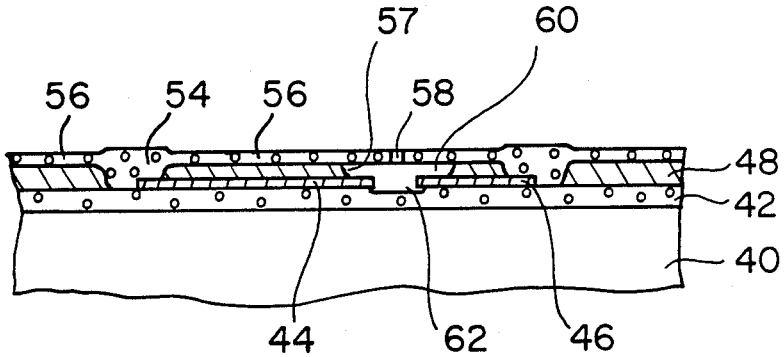
FIG. 3F
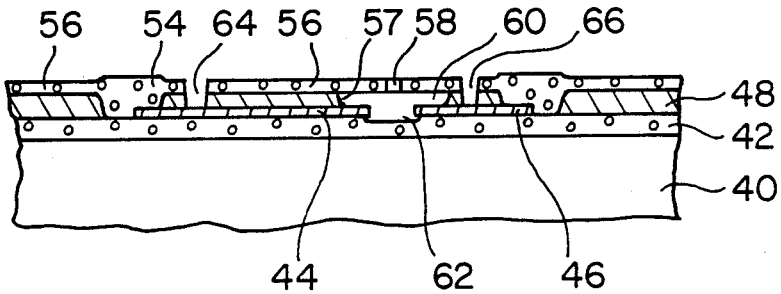
FIG. 3G
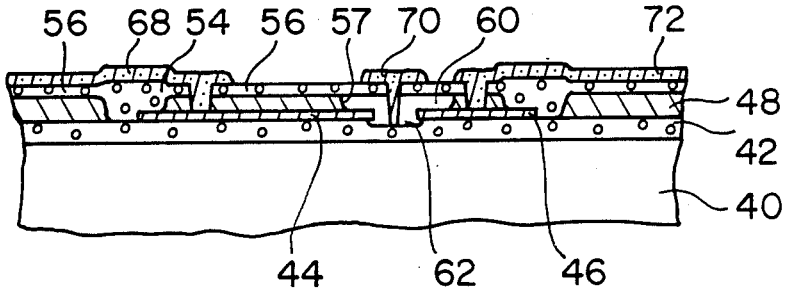
FIG. 3

MICROMACHINED COLD CATHODE VACUUM TUBE DEVICE AND METHOD OF MAKING

BACKGROUND OF THE INVENTION

This invention relates to micromachined vacuum tube devices and, more particularly, to cold cathode vacuum tube devices and a method of making such devices.

The electronic era began with the invention of the vacuum tube. Computer and memory applications were limited by the lack of an available technology allowing for cost effective miniaturization of the vacuum tube. Vacuum tube technology was essentially replaced with the invention of the transistor and the subsequent development of low-cost batch fabrication techniques for solid state integrated circuits. It is now possible to integrate upwards of $10^6$ transistors onto a silicon chip. However, the relatively low mobility of silicon imposes a limit in switching speed upon the silicon technology using the metal-oxide-semi conductor field effect transistor (MOSFET). Furthermore, solid state devices are temperature sensitive and subject to radiation induced drifts, limiting silicon technology for certain military applications.

These limitations have been overcome somewhat with the development of alternate semi conductor devices made, for example, of gallium arsenide (GaAs). Gallium arsenide's mobility is approximately an order of magnitude greater than silicon's and GaAs devices exhibit better resistance to the effects of radiation.

Unfortunately, because of optical and acoustic phonon scattering at bias levels which are typically required for logic operations, the carrier velocity for all semi conductors saturates at approximately 2 to $3\times10^7$ cm/sec (at room temperature). To reduce carrier transit time at a given saturation velocity, extensive research efforts are underway to shorten the distance between source and drain of the field effect transistor. Photolithography, materials, and cost limit the minimum gate dimensions achievable to about 0.5 micrometers.

Recently it has been suggested that vacuum devices can be made as small, and can be integrated to the same level, as solid state devices. R. Greene, H. Gray, and G. Campisi, "Vacuum Integrated Circuits", Technical Digest, International Electron Devices Meeting, Washington, D.C., Dec. 1–4, 1985, p. 172, IEEE, 85CH2252-5. Greene et al. describe two main approaches to vacuum integrated circuits (ICs): the thermionic IC and the field emitter IC. Although Greene et al. describe the concept of a basic field emitter tunneling triode, Greene et al. note that the field emitter IC faces difficulties with respect to fabrication techniques and fail to describe a method of making such a device.

Therefore, it is an object of the present invention to provide a method of making a field emitter or cold cathode vacuum device using solid state fabrication technology (micromachining).

It is another object of the present invention to describe a cold cathode vacuum device having a micromachined vacuum chamber.

Additional objects, advantages, and novel features of the invention will be set forth in the description which follows, and will become apparent in part to those skilled in the art upon examination of the following or may be learned by practice of the invention.

PRINCIPLE OF OPERATION

The field emitter or cold cathode is especially advantageous in a vacuum device if the very high current densities of quantum, i.e. Fowler-Nordheim, tunneling can be obtained. To achieve cold emission by Fowler-Nordheim tunneling of electrons from a metal into a vacuum, an electric field of approximately $E=1\times10^7$ V/cm is needed. Assuming a cathode-to-anode distance, d, of 6 micrometers, an operating voltage, V, of 6000 volts would be necessary (where $V=E\times d$). Since a needle-shaped cathode provides field enhancement at its tip, such a device can be operated at a voltage of several hundred volts or less. The field at the tip is given approximately by V/r, with r being the radius of the tip. Thus for a device to operate at approximately 200 volts, with a local field, E, of $1\times10^7$ V/cm, a tip radius, $r=V/E=2000$ Angstroms (0.2 micrometers), is required. This is well within the current state-of-the-art for microprocessing.

The switching time of a Fowler-Nordheim tunneling device is governed by the energy relation $eV=mv^2/2$, where e and m are the charge and mass, respectively, of the electron, V is the applied voltage, and v is the electron velocity. From this relationship, the velocity of free electrons is $v=5.93\times10^7V^{180}$ cm/sec. Thus, at V=200 volts, the electron velocity is approximately $8.4\times10^8$ cm/sec, which is an order of magnitude greater than the saturation velocity of any semi conductor. The time, t, for such an electron to travel a cathode-to-anode separation, d, of 6 micrometers, where $t=d/v$, is $6\times10^{-4}/8.4\times10^8=0.72$ picoseconds. These estimates for field enhancement and speed of operation can be refined using computer simulations which incorporate the exact shape of the field emitter tip and take into account parasitic device capacitances.

SUMMARY OF THE INVENTION

To achieve the foregoing and other objects, a triode according to the present invention may include a vacuum chamber, wherein the vacuum chamber includes a first insulating layer, a second insulating layer spaced apart from the first layer, and a side insulating layer positioned between and sealed to the first and second layers such that a vacuum space is formed within the first, second, and side layers; a cathode disposed within the vacuum chamber; an anode disposed within the vacuum chamber and spaced apart from the cathode; and a gate positioned between and spaced apart from the cathode and the anode. The cathode is a field emitter with a small radius of curvature, the shape of the anode is more conventional in that it is preferably plate-shaped, and the gate allows the modulation or switching of the cathode-to-anode current. The triode is fabricated using micromachining or solid state fabrication techniques. Unlike the conventional vacuum tube, the gate in the triode according to the invention may be fabricated either inside or outside of the vacuum chamber. The cathode and anode are formed on an insulating substrate, which forms one wall of the vacuum chamber. A second insulating layer is formed over the cathode and anode. A vacuum chamber is formed by etching a small cavity in the first insulating substrate around portions of the cathode and anode through etch holes in the second insulating layer. The cavity is subsequently sealed in vacuum during the gate formation step. The gate is preferably located outside the vacuum chamber. The side layer of the vacuum chamber is formed either by a highly resistive layer deposited prior to forming the second insulation layer or by oxidizing a portion of a polycrystalline silicon layer to form a silicon dioxide layer around the periphery of the vacuum chamber. The side and second insulating layers may also be formed in a single step process.

An important element of the triode is formation of the cold cathode tip. Several methods for forming the field emitter tip are described. One method consists of transferring a needle-shaped tip from a mask onto a substrate with optical or X-ray lithographical techniques. Another method consists of "writing" the cathode shape onto a photoresist layer using e-beam techniques, developing the photoresist, and etching the cathode forming material under the photoresist layer. A novel method is described using two intersecting lines. In a first masking step one straight line forming a side of the field emitter is defined and etched. Then a second layer of photoresist is applied and the complementary portion of the tip is defined by a second line, which intersects the first line, and etched. This method permits tips to be formed with very small radii of curvature.

DESCRIPTION OF THE DRAWINGS

FIGS. 3A through 3G show cross-sectional views at different processing stages during the formation of a triode according to a second embodiment of the invention.

DESCRIPTION OF THE PREFERRED EMBODIMENTS

Figure 1A:
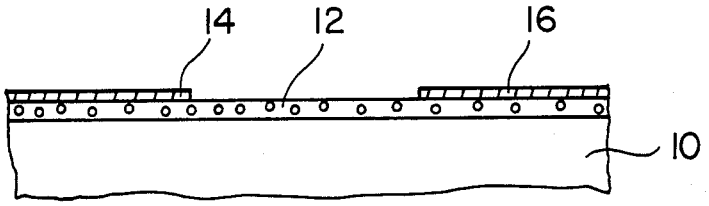
FIGS. 1A through 1E show cross-sectional views at different processing stages during the formation of a triode according to an embodiment of the invention.
Figure 1B:
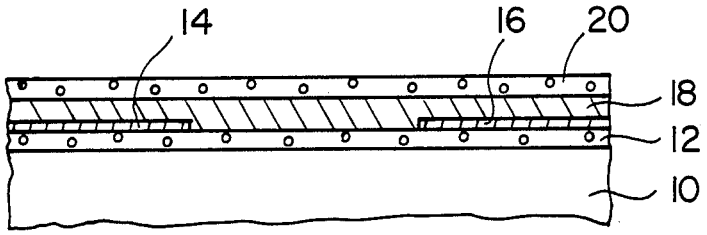
Figure 1C:
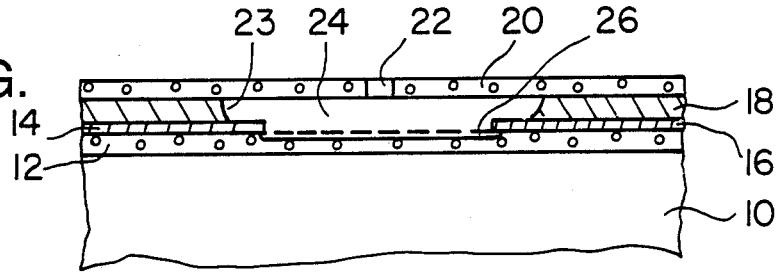
Figure 1D:
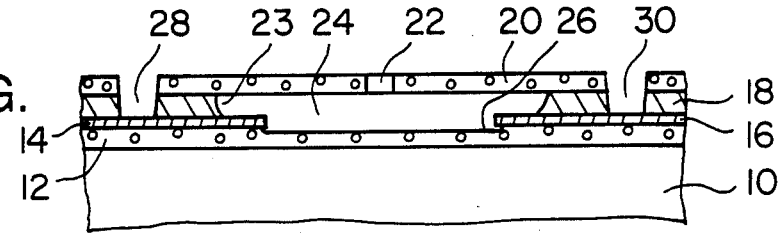
Figure 1E:
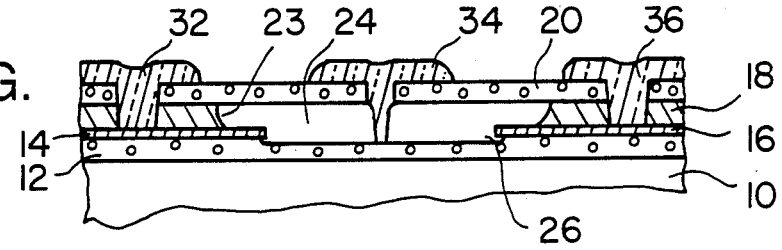
Figure 2:
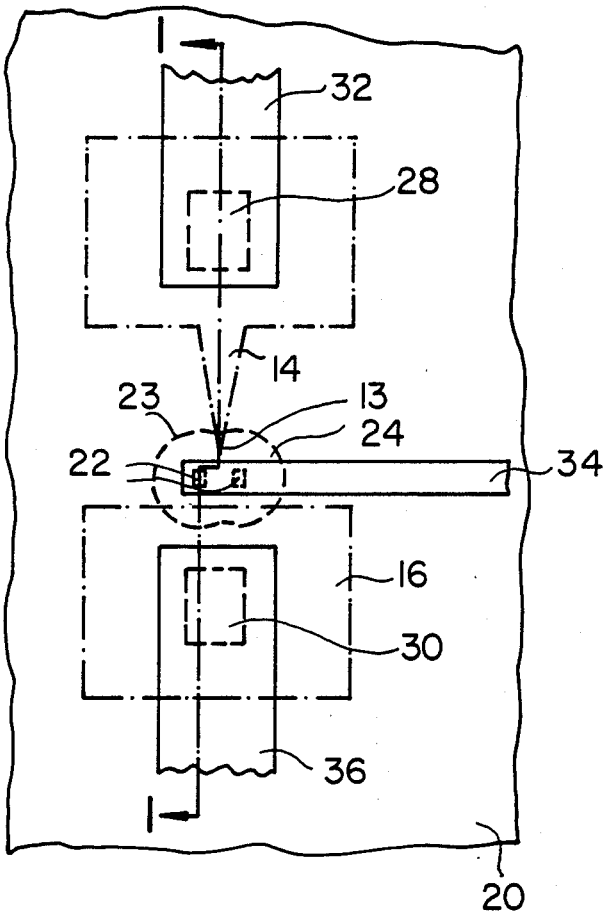
FIG. 2 shows a topographical view of the triode fabricated according to the method shown in FIGS. 1A to 1E.

Referring to FIGS. 1 and 2, a triode according to a first embodiment of the invention is shown. In FIG. 1A, the starting material or substrate 10 is chosen to be a silicon wafer on which a layer of approximately 1 micrometer of thermal silicon dioxide is grown forming first insulating layer 12. The cathode and anode are formed by depositing a layer of tungsten (or other suitable refractory metal such as molybdenum, platinum, or a refractory metal silicide) on top of layer 12. Preferably, the metal layer is deposited to a thickness of approximately 100 to 200 Angstroms by e-beam evaporation, sputtering, or chemical vapor deposition. The metal layer is then shaped into cathode region 14 and anode region 16 using conventional photolithographical techniques. The shapes of cathode 14 and anode 16 are shown in FIG. 2; cathode 14 is needle-shaped and anode 16 is shown as plate-shaped and spaced apart from and substantially perpendicular to tip 13 of cathode 14. The distance from tip 13 of cathode 14 to anode 16 can range from 3 to 20 micrometers. Instead of a metal cathode, cathode 14 can be formed of an electron emitting semi conductor such as phosphorus-doped silicon or of a semi conductor which provides a channel of electrons, i.e. a field inversion layer.

Referring to FIG. 1B, the entire structure is then covered with a layer of undoped polycrystalline silicon 18, preferably by low pressure chemical vapor deposition (LPCVD). Layer 18 will be etched to form the side layer of the vacuum chamber. Highly resistive polycrystalline silicon is chosen because it will form an insulating layer between cathode 14 and anode 16. Polycrystalline silicon having a resistivity of the order of $10^8$ ohm cm is preferred. Layer 18 is subsequently thermally oxidized in steam oxide at 1050 degrees C. to form oxide layer 20 on top of the remaining polycrystalline silicon of layer 18. Layer 18 was chosen such that oxide layer 20 and remaining portion of layer 18 have thicknesses of 0.2 to 0.5 micrometers each. It is important that oxide layer 20 be pinhole free, since it will form the top insulating layer of the vacuum chamber.

Referring to FIG. 1C, one or more contact windows 22 are formed in layer 20 using conventional lithography and a buffered HF solution is used to remove the silicon dioxide. The vacuum chamber is formed by using contact windows 22 to remove a portion of layer 18 to form a small cavity 24 extending from cathode 14 to anode 16 such that the field emitter tip 13 of cathode 14 and a portion of the anode 16 are completely free of polycrystalline silicon. Cavity or vacuum chamber 24 is bounded by bottom insulating layer 12, top insulating layer 20 and side wall 23 formed by etched layer 18. See FIGS. 1C and 2. Several methods can be used to remove the polycrystalline silicon. A preferred method is an EPW etch consisting of 660 ml ethylenediamine, 140 gm pyrocatechol, 330 ml water. Etching is performed at 100 degrees C. FIG. 2 shows the outline of the vacuum chamber 24. To ensure that tip 13 is surrounded by vacuum only and not by two interfaces, insulator on the bottom and vacuum on the remaining boundaries, approximately 100 to 400 Angstroms of insulating layer 12 can be removed by a short buffered HF etch. The resulting removed area is shown as region 26 in FIG. 1C.

Next contact windows 28 and 30 are defined and removed from layer 20 and layer 18 using standard wet and/or dry chemical etching techniques. Care should be taken so that none of the metal in regions 14 and 16 is removed in this step. It was found that the same EPW etch used to form cavity 24 yields good results in removing polycrystalline silicon from contact windows 28 and 30. The resulting structure is shown in FIG. 1D. To form the metal contacts and gate, the entire structure is covered with a layer of metal, such as aluminum, ranging in thickness from 1 to 1.5 micrometers, preferably in an e-beam evaporator and subsequently etched. Evaporation of aluminum fills metal into contact windows 28 and 30 forming metal interconnects 32 and 36 to cathode 14 and anode 16 respectively. This step also produces gate 34 and seals the vacuum chamber by filling in contact windows 22. Note that gate 34 is positioned between cathode 14 and anode 16 and is also substantially outside of vacuum chamber 24. See FIGS. 1E and 2. Gate 34 can also be formed by depositing a refractory metal, refractory metal silicide, or doped polycrystalline silicon. Cathode 14 and anode 16 are positioned within the vacuum chamber. The spacing and distances between the cathode, gate and anode can be defined and controlled during the photolithography steps.

Any excess metal deposited on layer 20 is then photolithographically defined to form contacts to gate 34 and to cathode 14 and anode 16. The cross-section of the final device is shown in FIG. 1E. This is also cut 1—1 in FIG. 2. The final device, shown in topographical view in FIG. 2, can now be integrated with other devices using conventional integrated circuit techniques to form small, medium, or very large scale (VLSI), high speed, radiation hardened integrated circuits.

The magnitude of the parasitic current through the undoped polycrystalline silicon layer 18, between anode 16 and cathode 14, may be deleterious to some VLSI applications. This current is calculated as follows. Assuming a resistivity of polycrystalline silicon of approximately $1\times10^8$ ohm cm, the effect of layer 18 can be approximated by two parallel resistors (one on each side of tip 13). Assuming a typical geometry of approximately $20\times20$ micrometers$^2$ and a thickness of approximately 0.5 micrometers (worst case), the resistance of one polycrystalline silicon resistor would be approximately $2\times10^{12}$ ohms. With an operation voltage of 500 volts, this results in a leakage current of 250pA (500pA for both current paths). For most logic applications this is an acceptable level. However, for some applications it would be desirable to reduce this value. This can be accomplished by replacing polycrystalline silicon side walls with silicon dioxide side walls.

Figure 3A:
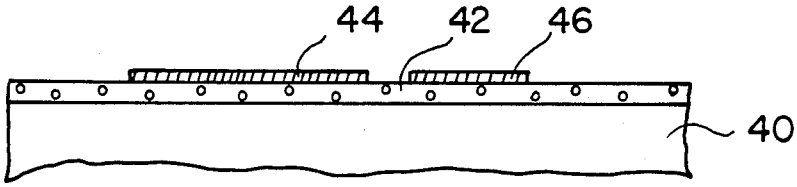
Figure 3B:
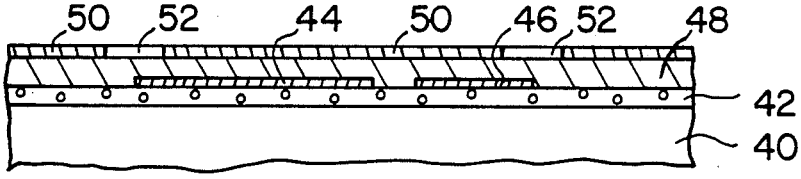
Figure 3C:
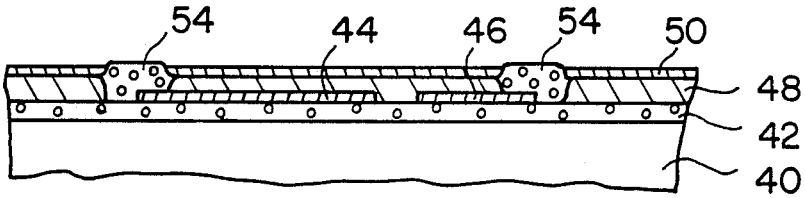
Figure 3D:
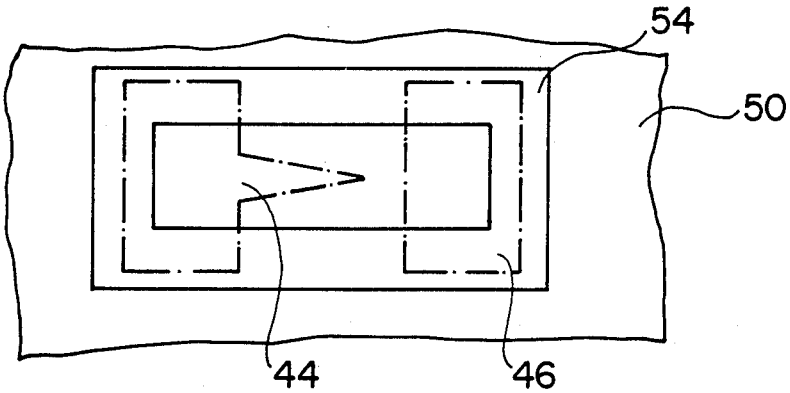

A triode having oxide walls is described with reference to FIGS. 3A to 3G and FIG. 4. Referring to FIG. 3A, substrate 40, preferably a silicon wafer, is shown on which approximately a 1 micrometer thick silicon dioxide layer 42 is grown using thermal oxidation. Cathode 44 and anode 46 are provided on layer 42 in the same fashion as described above with reference to FIG. 1A. The shapes of cathode 44 and anode 46 are shown in FIG. 3D and are similar to the shapes shown in FIG. 2. This step is followed by the deposition of polycrystalline silicon layer 48, by LPCVD, then deposition of layer 50 of approximately 1000 Angstroms thick silicon nitride, also by LPCVD. Referring to FIG. 3B, silicon nitride layer 50 is photoshaped and etched to form opening 52 in the form of two interimposed rectangles surrounding portions of cathode 44 and anode 46. The shape and location of opening 52 also determine a partial boundary of the vacuum chamber.

The portion of polycrystalline silicon of layer 48 within opening 52 is then converted into silicon dioxide to form side wall 54, preferably by a wet thermal oxidation step. The portion of silicon nitride layer 50 acts as an oxidation barrier during this process preventing the entire layer 48 from being converted. FIG. 3C shows the cross-section of the device after the oxidation step and FIG. 3D a topographical view of the resultant oxide isolation wall 54. Next the remaining silicon nitride layer 50 is removed and the exposed layer 48 is oxidized to form a 0.2 to 0.5 micrometer thick layer of silicon dioxide 56, leaving the remainder of layer 48 having a thickness of 0.2 to 0.5 micrometers, similar to that described in FIG. 1.

Figure 4:
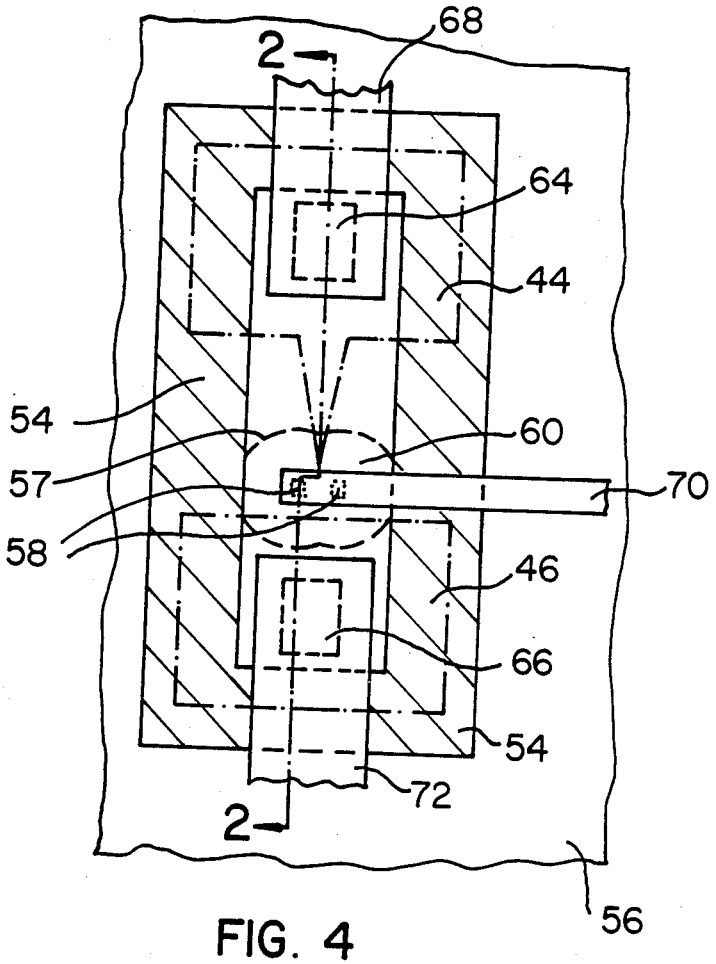
FIG. 4 shows a topographical view of the triode fabricated according to the method shown in FIGS. 3A to 3G.

FIG. 3E shows the device after formation of vacuum chamber etch holes 58, vacuum chamber etch 60, and cathode/anode undercut etch 62. These steps and the steps shown in FIGS. 3F and 3G are the same as those described with reference to FIG. 1. FIG. 3F shows the device after contact holes 64 and 66 are formed and layers 48 and 56 are etched to expose the metal of cathode 44 and anode 46. FIG. 3G shows the device after metal deposition to seal vacuum chamber 60, gate formation 70 and metallization etching to form interconnects 68 and 72 to cathode 44 and anode 46, respectively. This is also shown as cut 2—2 in FIG. 4. The topographical view of the resultant device is shown in FIG. 4. Note that the chamber etching process should be performed in a manner such that side wall surface 57 intersects region 54 to provide full electrical isolation between the cathode and anode.

The radius of curvature of the emitter tip must be controlled to be within 20 to 50 Angstroms of its design value, since the size of the emitter tip determines the magnitude of the local field and thus the turn-on voltage of the device. In addition, physical adsorption and chemisorption of molecules on the tip strongly affect the metal-to-vacuum barrier height and thus the tunneling probability which corresponds to non-reproducible turn-on behavior. Metal-to-vacuum barrier height can be controlled by precise control of the foregoing process. The shape of the emitter tip is controlled by photolithographical techniques. Preferably, this is accomplished by x-ray or e-beam lithography. Alternatively, a process where two etched lines intersect can be used to fabricate reproducible radii of curvature using optical lithography.

Figure 5A:
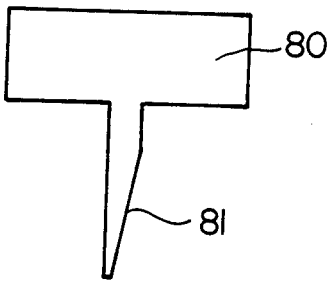
FIGS. 5A through 5C illustrate a method to form a needle-shaped cathode.
Figure 5B:
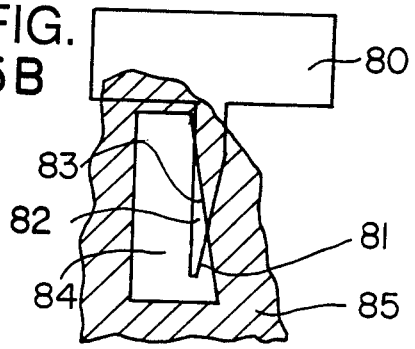
Figure 5C:
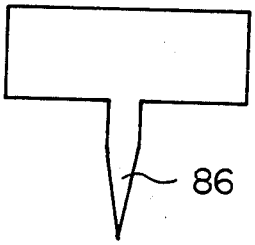

FIG. 5 shows a process to form the emitter tip. In FIG. 5A region 80 is a topographical view of a partially etched field emitter cathode. Line segment 81 forms one side of the field emitter. Metal 80 containing line segment 81 is then covered with photoresist 85 as shown in FIG. 5B and opening 84 is defined in photoresist 85 via a second mask step. The shape of opening 84 is chosen such that it contains line segment 83, which intersects line segment 81. After etching region 82 and photoresist removal, the resulting field emitter structure 86 is shown in FIG. 5C. This method overcomes limitations in mask fabrication, light exposure problems due to scattering effects, photoresist development near corners and rounding effects encountered at corners during metal etching. This method of fabricating a field emitter structure can be easily employed in the methods described above with respect to FIGS. 1, 2, 3, and 4 as well as the embodiment described below.

Figure 6A:
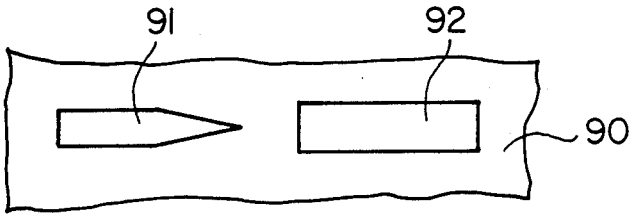
FIGS. 6A through 6E show cross-sectional views at different processing stages during the formation of a triode according to a third embodiment of the invention.
Figure 6B:
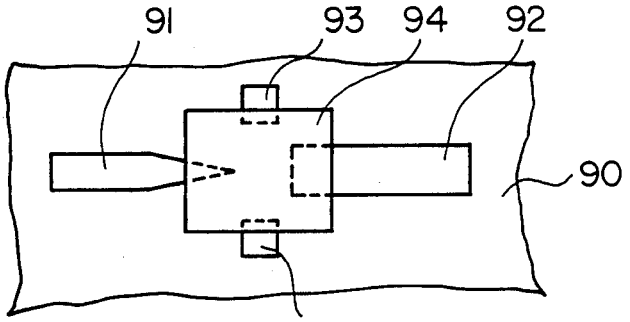

A third embodiment of the field emitter triode is described with reference to FIG. 6. Referring to FIG. 6A, cathode 91 and anode 92 are formed on insulating layer 90 in the same fashion as described above for the previous two embodiments. Referring to FIG. 6B, two sacrificial layers 93 are formed on insulating layer 90 and positioned such that each layer 93 is opposite the other layer 93 and such that layers 93 are on a line intersecting a line from the cathode to the anode. Preferably layer 93 is formed of approximately 1000 Angstroms thick aluminum. Next layer 94 is formed by depositing a material such as sputtered amorphous silicon which is subsequently photoshaped and etched to cover portions of cathode 91, anode 92 and layers 93. The thickness of layer 94 may be from 0.3 to 1.0 micrometers. The thickness of layer 94 will determine the depth of the resultant vacuum chamber.

Figure 6C:
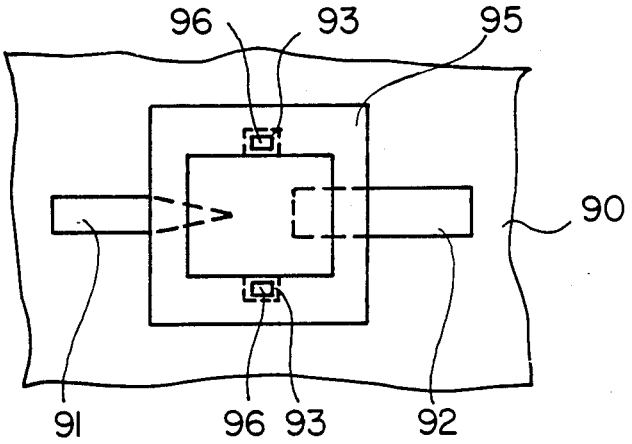

Referring to FIG. 6C, a layer of polyimide, preferably 1 micrometer thick, is deposited by spin coating and curing at a temperature of 200 to 250 degrees C. and photoshaped in an oxygen plasma using a thin layer of aluminum as a masking layer such that resultant region 95 covers layer 94 and layers 93 and etch openings 96 are formed, one each over layers 93 during the oxygen plasma step. Then aluminum is removed on top of region 95 and from layers 93 by etching through etch openings 96. This process forms access holes for subsequent etching of sacrificial layer 94 with an EPW etch.

Figure 6D:
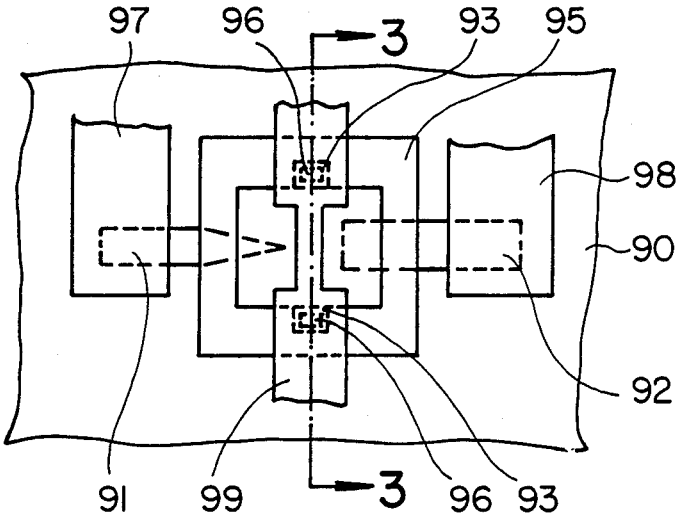
Figure 6E:
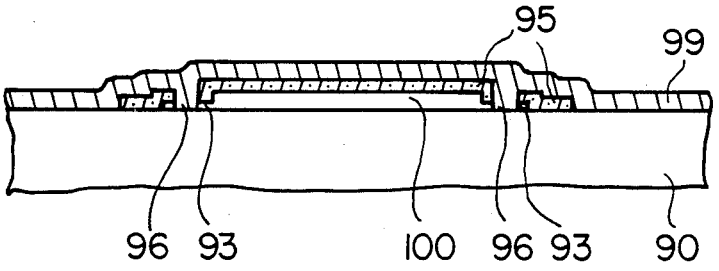

During this step etching solution enters the access holes 93 and starts to remove the amorphous silicon layer 94 forming chamber 100 as shown in FIG. 6E. As described above, the tip of cathode 91 and a portion of anode 92 can be separated from insulating layer 90 by a short buffered HF etch. After water rinsing and drying, chamber 100 is sealed during the gate formation step. Preferably approximately 1 to 1.5 micrometers of aluminum is deposited and photoshaped to form gate 99 and cathode interconnect 97 and anode interconnect 98. The resultant structure is shown in FIGS. 6D and 6E, where FIG. 6E is cut 3—3 of FIG. 6D.

We claim:

1. A device comprising:

a vacuum chamber, wherein said vacuum chamber comprises a first insulating layer, a second insulating layer spaced apart from said first layer, and a side insulating layer positioned between and sealed to said first layer and said second layer such that a vacuum space is formed within said first, second and side layers;

a cathode disposed within said vacuum chamber and on said first layer, wherein said cathode comprises a planar field emitter having a small radius of curvature tip; and an anode disposed within said vacuum chamber and on said first layer, spaced apart from said cathode; and a gate positioned between and spaced apart from said cathode and said anode.

2. The device of claim 1 wherein said field emitter is formed by the process of depositing a metal layer on said first insulating layer and etching said metal layer such that the boundary of said field emitter is formed by two intersecting etch lines.

3. The device of claim 1 wherein said first layer, said second layer and said side layer are formed of silicon dioxide.

4. The device of claim 1 wherein said first layer and said second layer are formed of silicon dioxide and said side layer is formed of highly resistive polycrystalline silicon.

5. The device of claim 1 wherein said cathode and said anode are formed of a material selected from the group consisting of refractory metals, platinum and refractory metal silicides.

6. The device of claim 1 wherein said gate is formed of a material selected from the group consisting of aluminum, refractory metals, doped polycrystalline silicon and refractory metal silicides.

7. The device of claim 1 wherein said cathode is formed of an electron emitting semi conductor.

8. The device of claim 1 wherein said second layer and said side layer are formed of a single layer of polyimide.

9. A method of making a device comprising the steps of:

providing a first insulating layer;

forming a cathode on said first layer, wherein said cathode comprises a planar field emitter having a small radius of curvature tip;

forming an anode on said first layer, said anode being spaced apart from said cathode;

forming a side insulating layer on said first layer such that portions of said cathode and said anode are contained within said side layer;

forming a second insulating layer on said side layer such that said second layer, said side layer and a portion of said first layer form a vacuum chamber having portions of said cathode and said anode contained therein; and forming a gate such that said gate is positioned between and apart from said cathode and said anode.

10. The method of claim 9 wherein said gate is formed by forming an opening in said second insulating layer and depositing a metal on said second layer such that metal fills the opening in the second layer sealing said chamber.

11. The method of claim 9 wherein said second layer and said side layer are formed according to the step.:

depositing a layer of polycrystalline silicon on said first layer such that said polycrystalline silicon covers portions of said anode and said cathode;

forming a layer of silicon dioxide on said polycrystalline silicon layer;

forming an opening in said silicon dioxide layer;

etching said polycrystalline silicon layer through said opening such that a chamber is formed having said first layer as a bottom layer, said polycrystalline silicon layer as a side layer, and said silicon dioxide layer as said second layer.

12. The method of claim 10 further comprising the step of prior to said gate formation, etching said first layer such that a portion of said first layer is removed from under a portion of said cathode and said anode.

13. The method of claim 9 wherein said side layer is formed according to the steps:

depositing a layer of polycrystalline silicon on said first layer covering portions of said cathode and said anode;

depositing an oxidation barrier on said polycrystalline silicon layer;

forming a ring-shaped opening in said oxidation barrier, such that portions of said cathode and said anode are contained within said ring-shaped opening;

oxidizing said polycrystalline silicon layer through said ring-shaped opening such that a portion of said polycrystalline silicon layer is oxidized to form a ring-shaped side layer of silicon dioxide; and removing said oxidizing barrier.

14. The method of claim 9 wherein said cathode is formed according to the steps:

depositing a layer of metal on said first layer;

etching said metal layer such that one boundary of said etched metal layer forms a first line segment;

covering said etched metal layer with a layer of photoresist;

removing a portion of said photoresist to expose a portion of said etched metal layer, one boundary of said removed photoresist forming a second line segment which intersects said first line segment; and etching said exposed portion of said etched metal layer.

15. The method of claim 9 wherein said second layer and said side layer are formed according to the steps:

depositing a layer of aluminum on said first layer, said aluminum layer being positioned apart from said cathode and said anode;

depositing a layer of amorphous silicon on said first layer such that said aluminum layer and portions of said cathode and said anode are covered;

depositing a layer of polyimide on said amorphous silicon layer;

forming an opening in said polyimide layer, said opening being positioned substantially over said aluminum layer;

removing aluminum from said aluminum layer by etching through said opening;

etching said amorphous silicon layer through said opening such that a chamber is formed having said first layer as a bottom layer and said polyimide layer as said second and said side layer.

16. The device of claim 1 wherein said gate comprises one or more metal posts within said vacuum chamber and a metal strip, connected to said posts, substantially outside said vacuum chamber.

17. The device of claim 16 wherein said gate is formed by the process of etching one or more openings in said second insulating layer and depositing a metal on said second layer such that metal fills said openings in said second layer forming said metal posts and etching said metal on said second layer to form said metal strip.

18. A method of making a planar field emitter, having a small radius of curvature tip, for use in a vacuum device comprising the steps of:

depositing a layer of metal on an insulating layer;

etching said metal layer such that one boundary of said etched metal layer forms a first line segment;

covering said etched metal layer with a layer of photoresist;

removing a portion of said photoresist to expose a portion of said etched metal layer such that one boundary of said removed photoresist forms a second line segment which intersects said first line segment; and etching said exposed portion of said etched metal layer.

* * * * *